US011930924B2

(12) United States Patent
Tontarelli

(10) Patent No.: US 11,930,924 B2
(45) Date of Patent: Mar. 19, 2024

(54) CUTLERY TRAY COMPRISING INCLINED CAVITIES FOR KITCHEN UTENSILS

(71) Applicant: Sergio Tontarelli, Castelfidardo (IT)

(72) Inventor: Sergio Tontarelli, Castelfidardo (IT)

( * ) Notice: Subject to any disclaimer, the term of this patent is extended or adjusted under 35 U.S.C. 154(b) by 0 days.

(21) Appl. No.: 18/001,112

(22) PCT Filed: Jun. 4, 2021

(86) PCT No.: PCT/EP2021/065011

§ 371 (c)(1),
(2) Date: Dec. 8, 2022

(87) PCT Pub. No.: WO2021/254796

PCT Pub. Date: Dec. 23, 2021

(65) Prior Publication Data

US 2023/0210259 A1 Jul. 6, 2023

(30) Foreign Application Priority Data

Jun. 19, 2020 (IT) ..... 102020000014809
Aug. 6, 2020 (IT) ..... 102020000019567

(51) Int. Cl.
*A47B 77/14* (2006.01)
*A47B 88/988* (2017.01)

(52) U.S. Cl.
CPC ..... *A47B 77/14* (2013.01); *A47B 88/988* (2017.01)

(58) Field of Classification Search
CPC ... A47B 2210/07; A47B 77/14; A47B 88/988; A47B 88/994; A47B 88/969; A47B 88/975; A47G 21/14
See application file for complete search history.

(56) References Cited

U.S. PATENT DOCUMENTS 833,049 A * 10/1906 Harnish ..... A47B 88/988 312/273
935,419 A * 9/1909 Smith ..... A61C 19/02 211/60.1

(Continued)

FOREIGN PATENT DOCUMENTS

CA 2758777 A1 5/2013
DE 202005011024 U1 10/2005

(Continued)

OTHER PUBLICATIONS

International Search Report for corresponding PCT/EP2021/065011, dated Aug. 19, 2021.

(Continued)

*Primary Examiner* — Patrick D Hawn
(74) *Attorney, Agent, or Firm* — Egbert, McDaniel & Swartz, PLLC

(57) ABSTRACT

Disclosed is a cutlery tray having at least one longitudinal cavity wherein cutlery is to be disposed. The longitudinal cavity has an inclined bottom surface and two longitudinal lateral edges with the inclined bottom surface in intermediate position between them. The cutlery tray importantly has an inclined mobile partition disposed in the longitudinal cavity, between the two longitudinal lateral edges, as well as connections configured in such a way that the inclined mobile partition can be alternatively disposed in a first position, wherein the inclined mobile partition is superimposed to the inclined bottom surface, and in a second position, wherein the inclined mobile partition projects with respect to the inclined bottom surface in such a way to increase the length of the supporting surface for the cutlery.

11 Claims, 10 Drawing Sheets

(56) References Cited

U.S. PATENT DOCUMENTS 1,746,503 A 2/1930 Timmons
1,857,305 A * 5/1932 Holliday ..... G07D 11/12 206/561
3,515,283 A * 6/1970 Poteat ..... A47B 88/988 211/55
3,703,326 A * 11/1972 Riviers ..... A47B 88/90 312/348.3
3,786,927 A * 1/1974 Manheim ..... A47F 7/0246 312/9.9
4,312,548 A * 1/1982 Posso ..... A47B 88/969 312/9.52
4,756,581 A * 7/1988 Phillips ..... B42F 17/10 312/348.3
4,993,786 A * 2/1991 De Giulio ..... A47B 88/994 312/301
5,037,165 A * 8/1991 Rapp ..... A47B 88/994 248/340
5,058,765 A * 10/1991 Gomi ..... G07G 1/0027 220/528
5,520,286 A * 5/1996 Murakoshi ..... G07G 1/0027 235/22
5,992,959 A * 11/1999 Kawamoto ..... A47B 88/994 312/348.3
6,619,773 B2 * 9/2003 Amsterdam ..... B42F 15/007 312/348.3
6,695,419 B2 * 2/2004 Searer ..... A47B 88/975 312/348.3
8,684,222 B2 * 4/2014 Tesink ..... A47G 23/0633 206/557
8,807,355 B2 * 8/2014 Merey ..... A47B 97/00 312/348.3
8,833,881 B2 * 9/2014 Manniso ..... A47B 88/90 312/265.5
9,380,915 B2 * 7/2016 Sabounjian ..... A47J 31/44
10,251,500 B2 * 4/2019 Marcu ..... A47G 21/14
D944,602 S * 3/2022 Chen ..... D7/637
11,503,910 B1 * 11/2022 Carmen ..... A47B 88/975
11,510,492 B1 * 11/2022 Chapman ..... A47B 88/994
2007/0159040 A1 * 7/2007 Fernandez ..... B25H 3/023 312/348.3
2008/0202976 A1 * 8/2008 Burgess ..... A47B 88/994 206/557
2011/0084584 A1 * 4/2011 Curtin ..... A47B 97/00 312/348.3
2012/0262043 A1 * 10/2012 Lechert, Jr. ..... A47B 88/994 312/348.3

FOREIGN PATENT DOCUMENTS

DE 202009002000 U1 * 9/2010 ..... A47B 77/14
DE 202020106114 U1 * 12/2020 ..... A47J 47/16
GB 2167389 A 5/1986
KR 20160031066 A * 3/2016 ..... A47B 77/14
KR 101779874 B1 * 9/2017 ..... A47B 77/14

OTHER PUBLICATIONS

Written Opinion of the International Searching Authority for corresponding PCT/EP2021/065011 dated Aug. 19, 2021.

* cited by examiner

CUTLERY TRAY COMPRISING INCLINED CAVITIES FOR KITCHEN UTENSILS

The present patent application for industrial invention relates to a cutlery tray that is preferably suitable for being housed in a drawer of a kitchen cabinet.

More precisely, said cutlery tray is provided with a series of cavities; each cavity is defined by edges with respect to the other cavities and is suitable for housing cutlery, such as forks, knives, spoons or teaspoons, or kitchen utensils that are generally longer than said cutlery.

At present, said cutlery trays are mostly made by molding plastic materials or they can be made of other materials, such as wood, by putting together a series of longitudinal or transverse edges with a rectangular base, in order to obtain said cavities.

In any case, there are two macro-categories of cutlery trays, which differ according to the configuration of the base wall of said cavities.

The first type is definitely the most common one and comprises cavities with a horizontal base wall wherein the objects are suitable for being arranged in a substantially horizontal position, whereas the second type comprises cavities with an inclined base wall wherein the objects are suitable for being arranged in an inclined, non-horizontal position.

In both cases said cavities develop along a longitudinal trajectory, i.e. along a trajectory that is orthogonal to the front edge and to the back edge of the cutlery tray and consequently parallel to the two lateral edges of the cutlery tray.

Otherwise said, such a second type of cutlery tray comprises one or more longitudinal rows of longitudinal cavities having:

- an inclined bottom surface comprising an upper transverse section and a lower transverse section that is disposed at a lower height with respect to said upper transverse section;
- two longitudinal lateral edges with said inclined bottom surface disposed in intermediate position;
- a transverse edge arranged in the lower transverse section and extending between the two longitudinal lateral edges.

Such a cavity provides a supporting surface that has the same length as said inclined bottom surface; therefore, if a user intends to store a kitchen utensil that is longer than said inclined bottom surface in said cavity, said kitchen utensil would be disposed incorrectly.

More precisely, a kitchen utensil longer than said inclined bottom surface may not fit in the cavity or may need to be disposed in such a way that a portion of it protrudes from the upper section of said cavity, thus being disposed incorrectly.

If excessively long, such a kitchen utensil may project in such a way to be unstable inside the cutlery tray and would tend to move during the opening or closing of the drawer wherein the cutlery tray is housed.

The purpose of the present invention is to disclose a cutlery tray capable of overcoming the aforementioned problem in such a way that said cavity can firmly house not only cutlery, but also kitchen utensils with a higher length.

An additional purpose of the present invention is to disclose a cutlery tray that is capable of using the space available in the cutlery tray in the most efficient way possible.

These purposes are achieved according to the invention with the characteristics of the appended independent claim 1.

Advantageous embodiments appear from the dependent claims.

The cutlery tray according to the invention is defined by claim 1.

For the sake of clarity, the description of the cutlery tray according to the invention continues with reference to the appended drawings, which have a merely illustrative, not limiting value, wherein.

Figure 1:
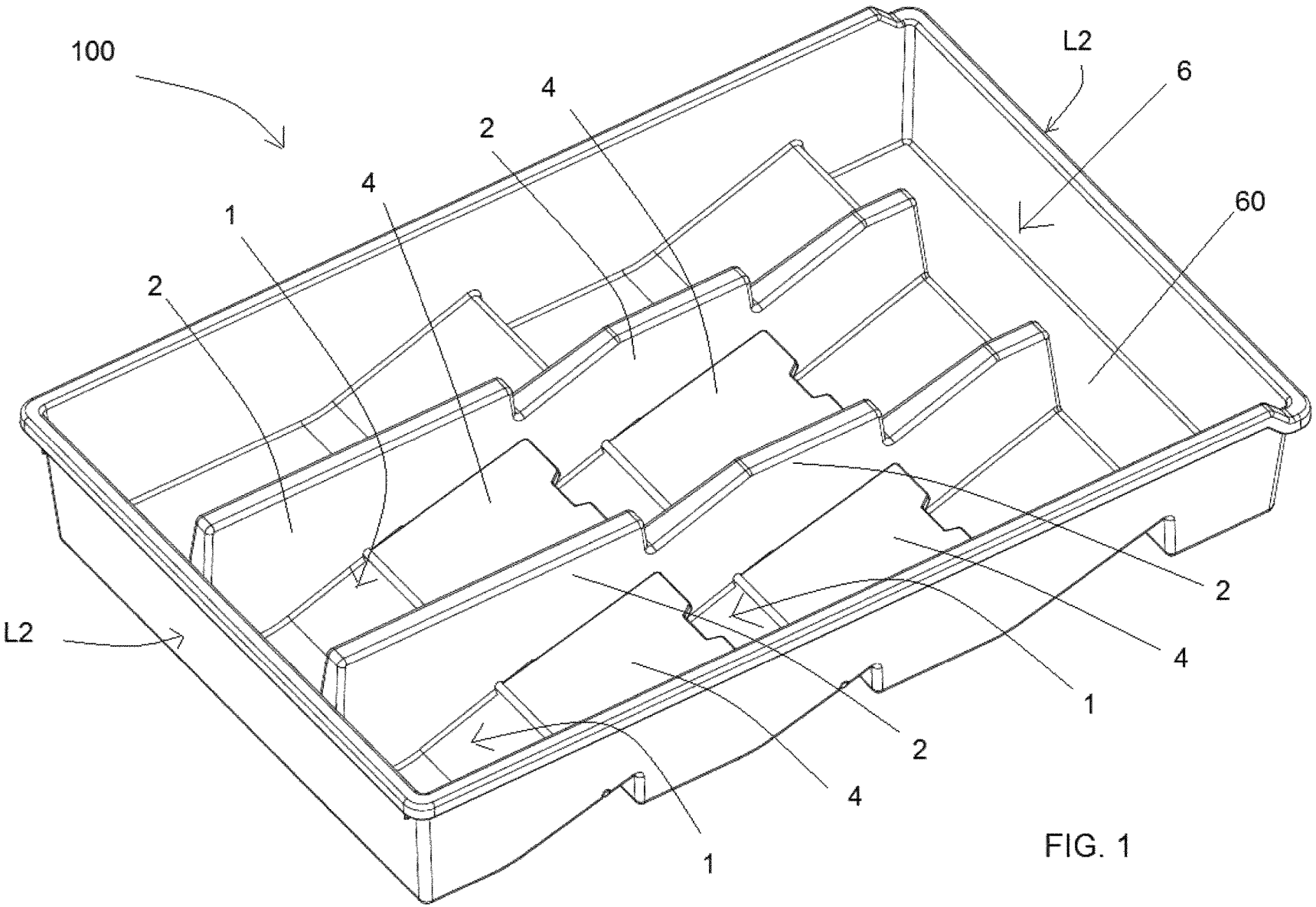
FIG. 1 is an axonometric view of the cutlery tray according to the invention.

With reference to the appended figures, a cutlery tray according to the present invention is disclosed, which is generally indicated with reference numeral (100).

The cutlery tray (100) comprises a box supporting structure comprising two longitudinal border edges (L1) and two transverse border edges (L2) and a bottom surface (L3).

The cutlery tray (100) comprises one or more longitudinal rows of longitudinal cavities (1); each longitudinal cavity (1) comprises:

- an inclined bottom surface (10) comprising an upper transverse section (10*a*) and a lower transverse section (10*b*) that is disposed at a lower height than said upper transverse section (10*a*);
- two longitudinal lateral edges (2) with said inclined bottom surface (10) in intermediate position between them;
- a transverse edge (3) that is disposed in the lower transverse section (10*b*) and extends between the two longitudinal lateral edges (2); said transverse edge (3) acting as stop edge for the cutlery or the kitchen utensils disposed inside the longitudinal cavity (1).

Figure 3:
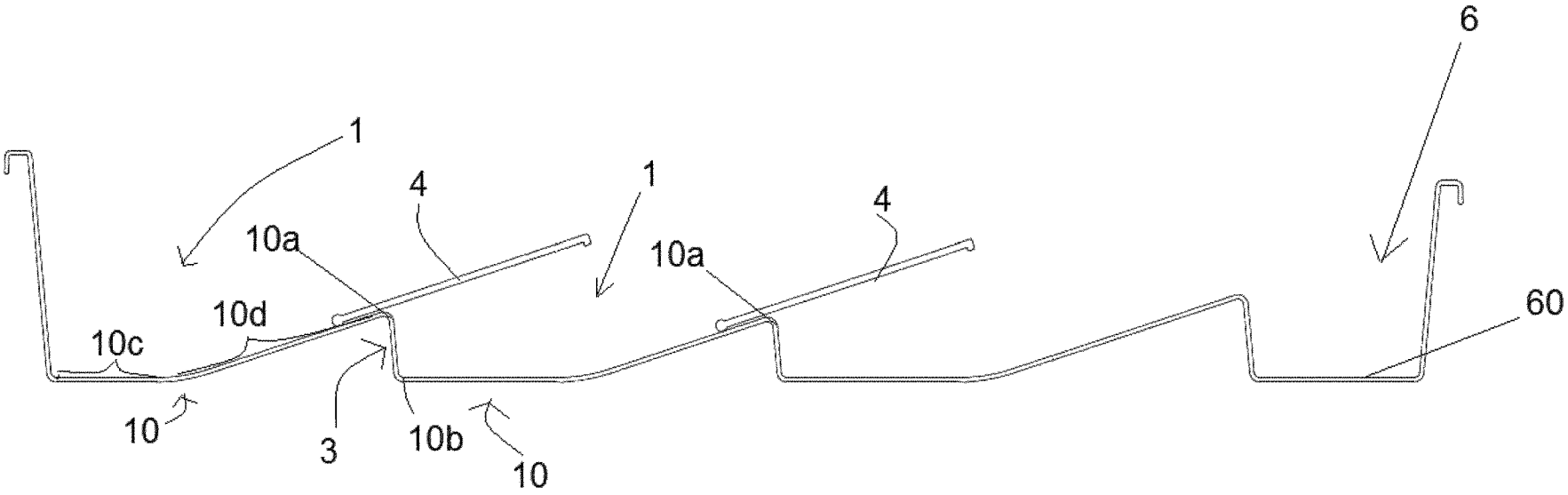
FIG. 3 is a side view of a row of longitudinal cavities of the cutlery tray according to the invention.

With reference to FIG. 3, said inclined bottom surface (10) of each longitudinal cavity (1) comprises two portions (10*c*, 10*d*) with different inclination.

In particular, said inclined bottom surface (10) comprises a first horizontal portion (10*c*) wherein said lower transverse section (10*b*) of the inclined bottom surface is disposed, and a second non-horizontal (inclined) portion (10*d*) wherein said upper transverse section (10*a*) is disposed.

In the embodiment shown in the appended figures, the cutlery tray (100) comprises three rows of longitudinal cavities (1), namely two external rows and one central row disposed between the two external rows.

Each one of the three rows comprises two or more consecutive longitudinal cavities (1) that are aligned in longitudinal direction and have the same width.

Figure 2:
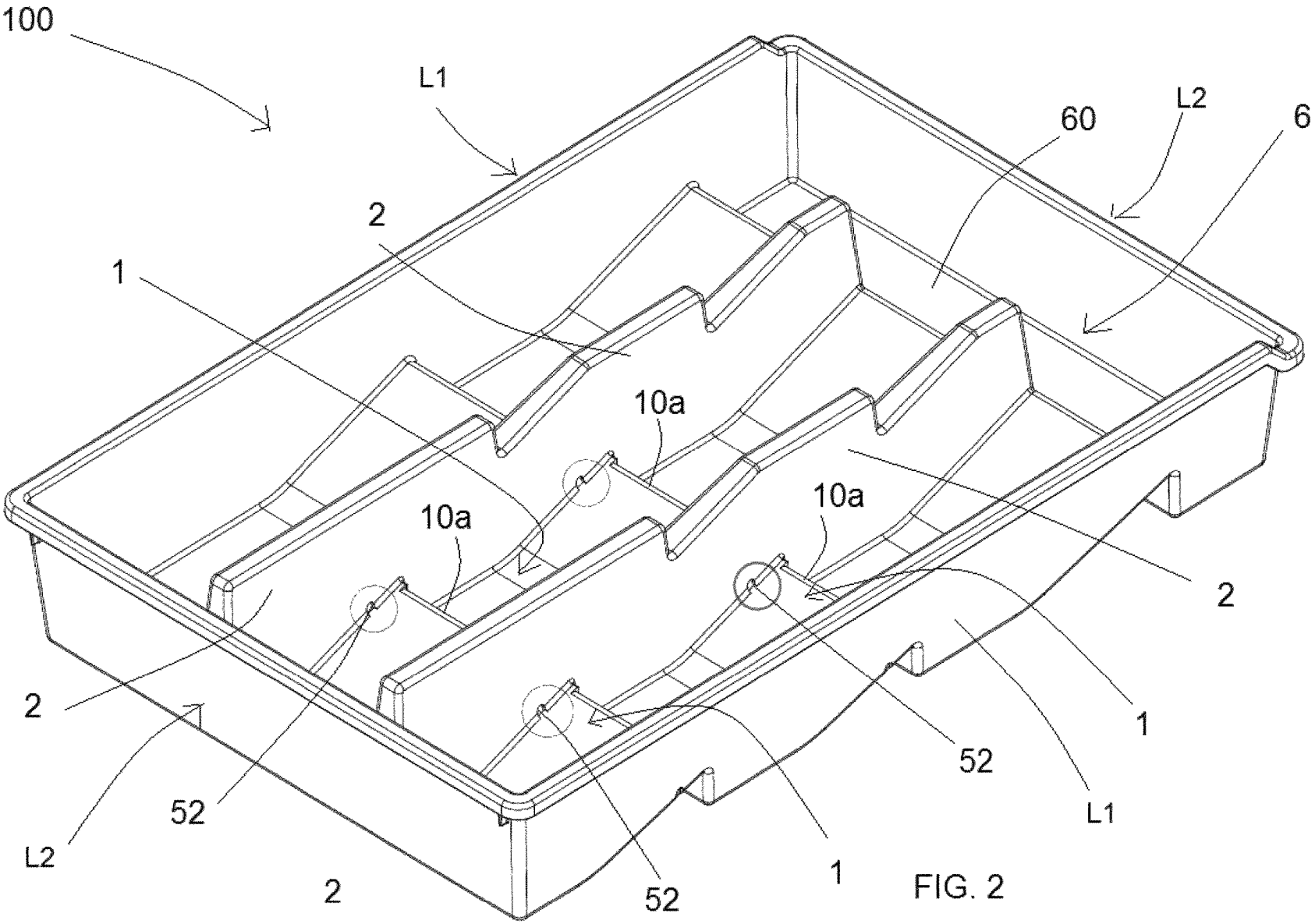
FIG. 2 is an axonometric view of the cutlery tray of FIG. 1, wherein the mobile partitions are omitted.

In particular, with reference to FIGS. 1 and 2, with reference to said three rows of longitudinal cavities (1), the central row and one of said external rows comprise three consecutive longitudinal cavities (1), whereas the other external row only comprises two consecutive longitudinal cavities (1).

With reference to FIGS. 1 and 2, the cutlery tray (100) also comprises a transverse cavity (6) comprising a horizontal bottom surface (60) obtained in proximal position to a transverse border edge (L2) and having a higher width than the longitudinal cavity (1).

More precisely, the transverse cavity (6) extends for the entire width of the cutlery tray (100), namely between the two longitudinal border edges (L1) of the cutlery tray (100).

Preferably, the longitudinal lateral edges (2) of the two or more longitudinal cavities (1) of a row are monolithic.

It should be noted that the longitudinal border edges (L1) coincide with one of the longitudinal lateral edges (2) of the external rows of longitudinal cavities (1).

With reference to FIGS. 1 and 2, the longitudinal lateral edges (2) extend from a transverse border edge (L2) to the transverse cavity (6).

According to an alternative form of the invention (not shown in the appended figures), wherein the cutlery tray (100) is devoid of said transverse cavity (6), said longitudinal lateral edges (2) extend for the entire length of the cutlery tray (100), more precisely between the two longitudinal border edges (L1).

The longitudinal lateral edges (2) can be made in one piece with the cutlery tray (100), or they can be attached by means of quick-connection means for the longitudinal lateral edges.

For illustrative purposes, said quick-connection means may consist in:

- teeth, projections, or elastic snap-in ribs obtained on the lower end of the longitudinal lateral edge (2);
- seats obtained on the bottom of the structure of the cutlery tray (100) wherein said teeth, projections or elastic snap-in ribs are firmly inserted.

The peculiarity of the cutlery tray (100) according to the invention is that it comprises:

- at least one inclined mobile partition (4) disposed in said longitudinal cavity (1) between the two longitudinal lateral edges (2); and
- connecting means that connect the inclined mobile partition (4) to the structure of the cutlery tray (100).

The connecting means are suitably configured in such a way that the inclined mobile partition (4) can be alternately disposed in:

- a first position, wherein the inclined mobile partition (4) is superimposed and parallel to said inclined bottom surface (10); and
- a second position, wherein the inclined mobile partition (4) projects from the inclined bottom surface (10) beyond the upper transverse section (10*a*), so as to increase the length of the supporting surface for cutlery or for the kitchen utensils stored in the longitudinal cavity (1).

In particular, according to the embodiment shown in FIG. 1, the cutlery tray (100) comprises four inclined mobile partitions (4), each one of them being associated to a longitudinal cavity (1).

Figure 5:
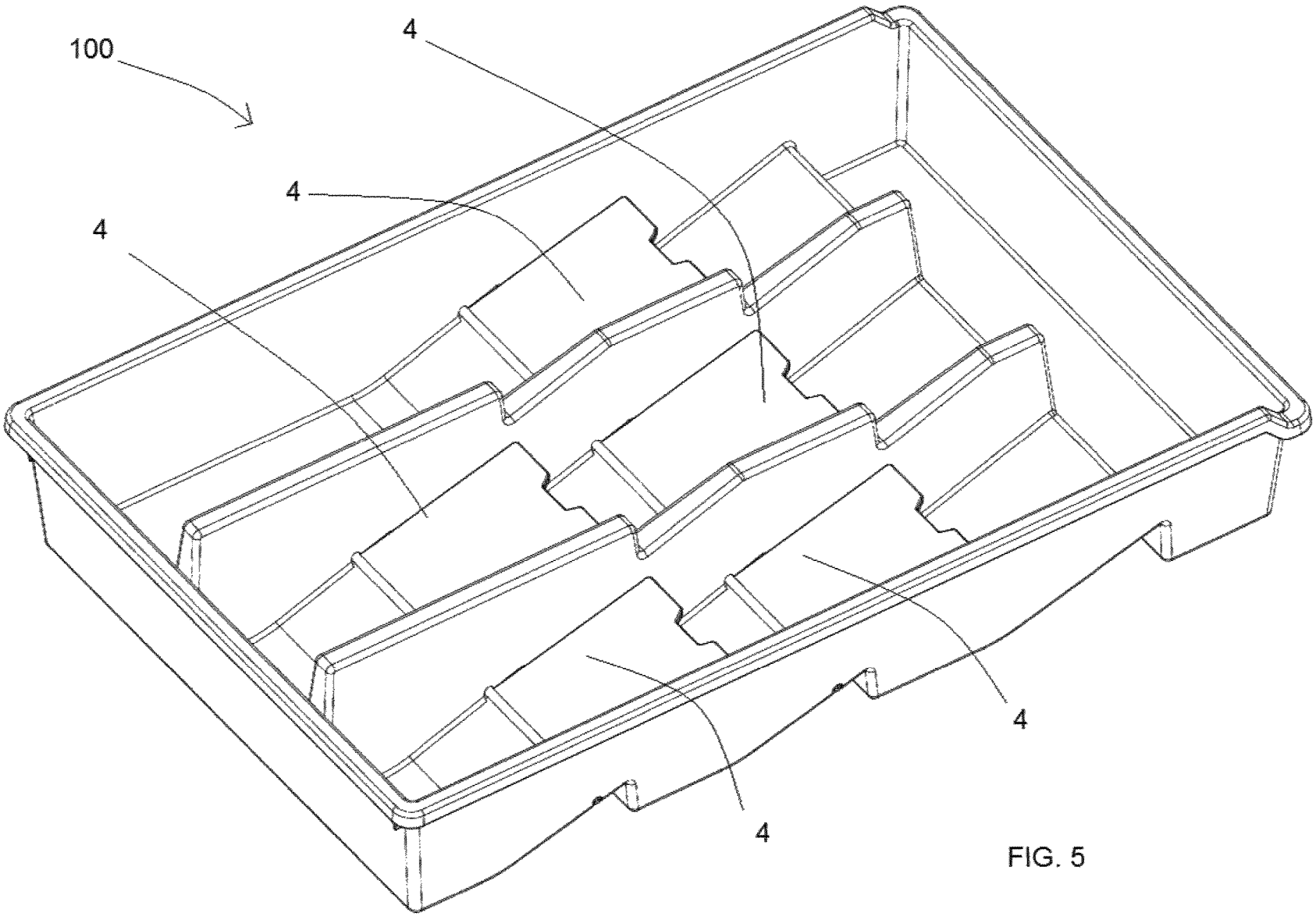
FIG. 5 is an axonometric view of the cutlery tray according to the invention in a second embodiment.

According to an additional embodiment shown in FIG. 5, the cutlery tray (100) comprises five inclined mobile partitions (4).

It must be noted that, although in FIGS. 1 and 5 the cutlery tray (100) comprises four and five inclined mobile partitions (4), the cutlery tray (100) may comprise any number of inclined mobile partitions (4) as long as said number is lower than or equal to the number of longitudinal cavities (1) that are provided in the cutlery tray (100).

Figure 4:
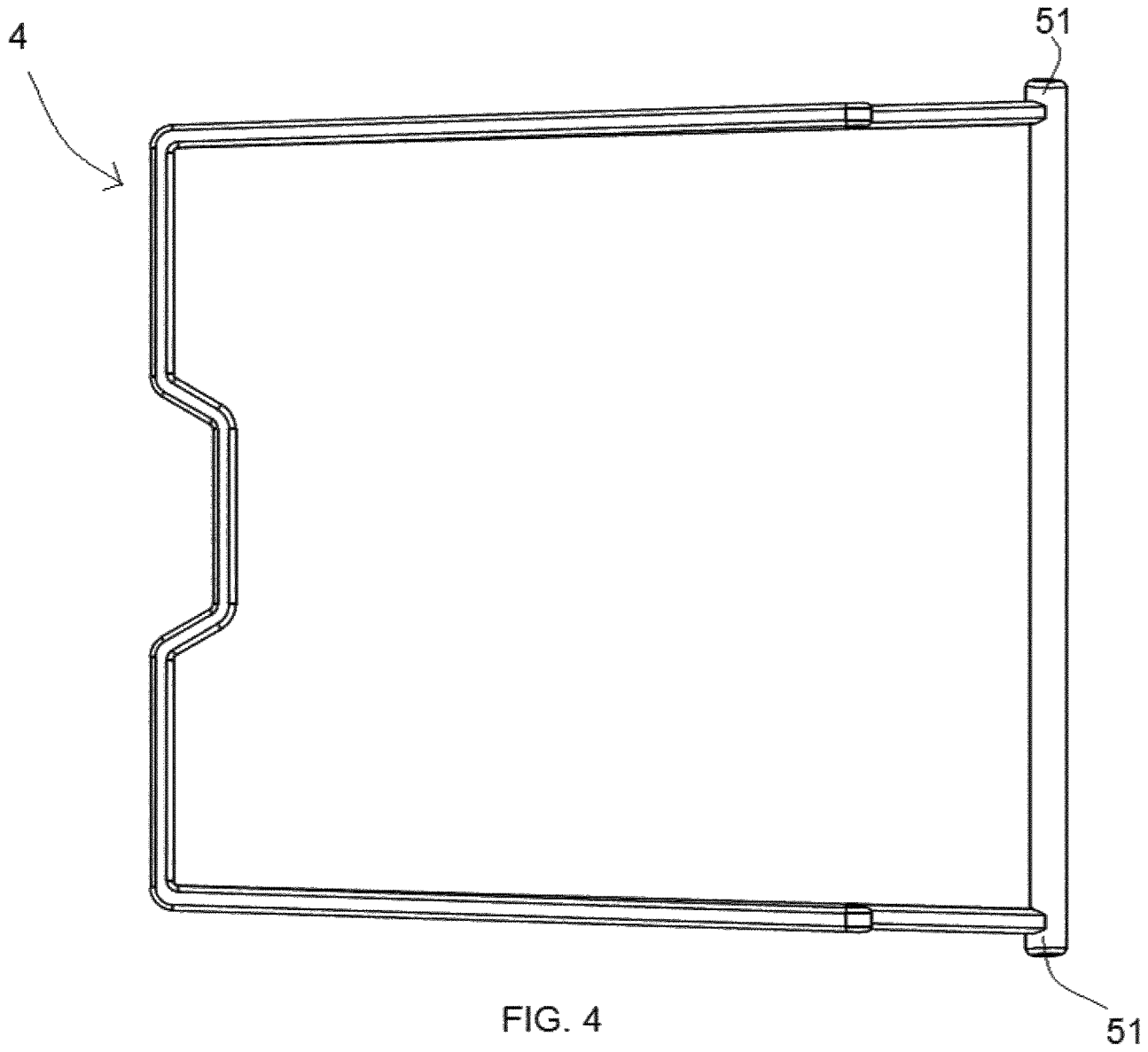
FIG. 4 is a top view of a mobile partition of the cutlery tray according to the invention.

With reference to FIGS. 2 and 4, according to the preferred embodiment of the invention, said connection means comprise:

- a pair of lateral pins ((51) in axially aligned position, each one of them being connected to the inclined mobile partition (4) and being directed towards one of the two longitudinal lateral edges (2);
- a pair of holes (52) in axially aligned position, each one of them being obtained in one of said two longitudinal lateral edges (2) and revolvingly housing one of said lateral pins (51).

It should be noted that in order to achieve the objectives pursued by the invention, nothing would change if said connection means were of a different type.

Figure 7:
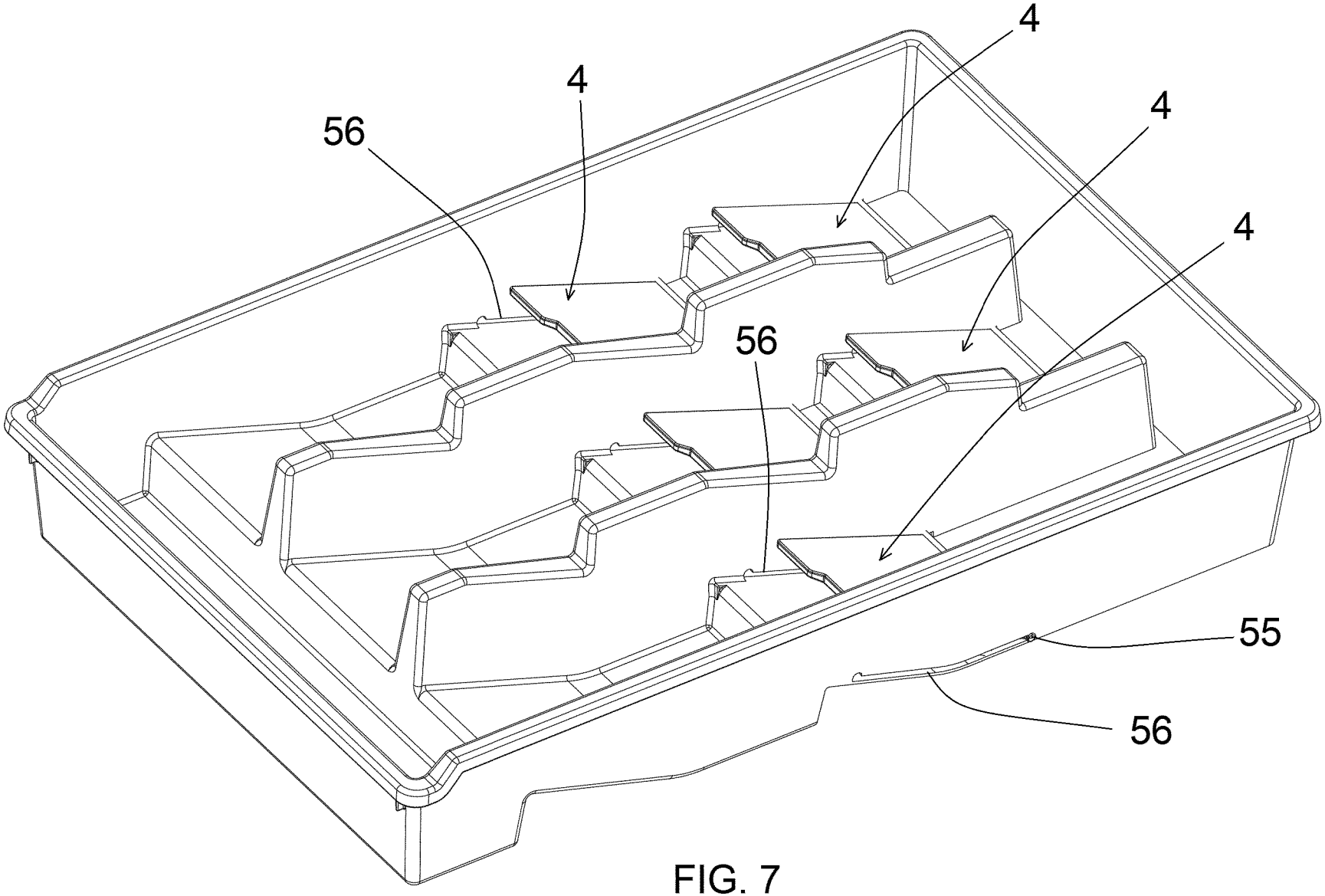
FIGS. 7 and 7A are two axonometric views of the cutlery tray according to an alternative embodiment of the invention that differs from the preceding embodiment in the type of connection means of the mobile partitions.
Figure 7A:
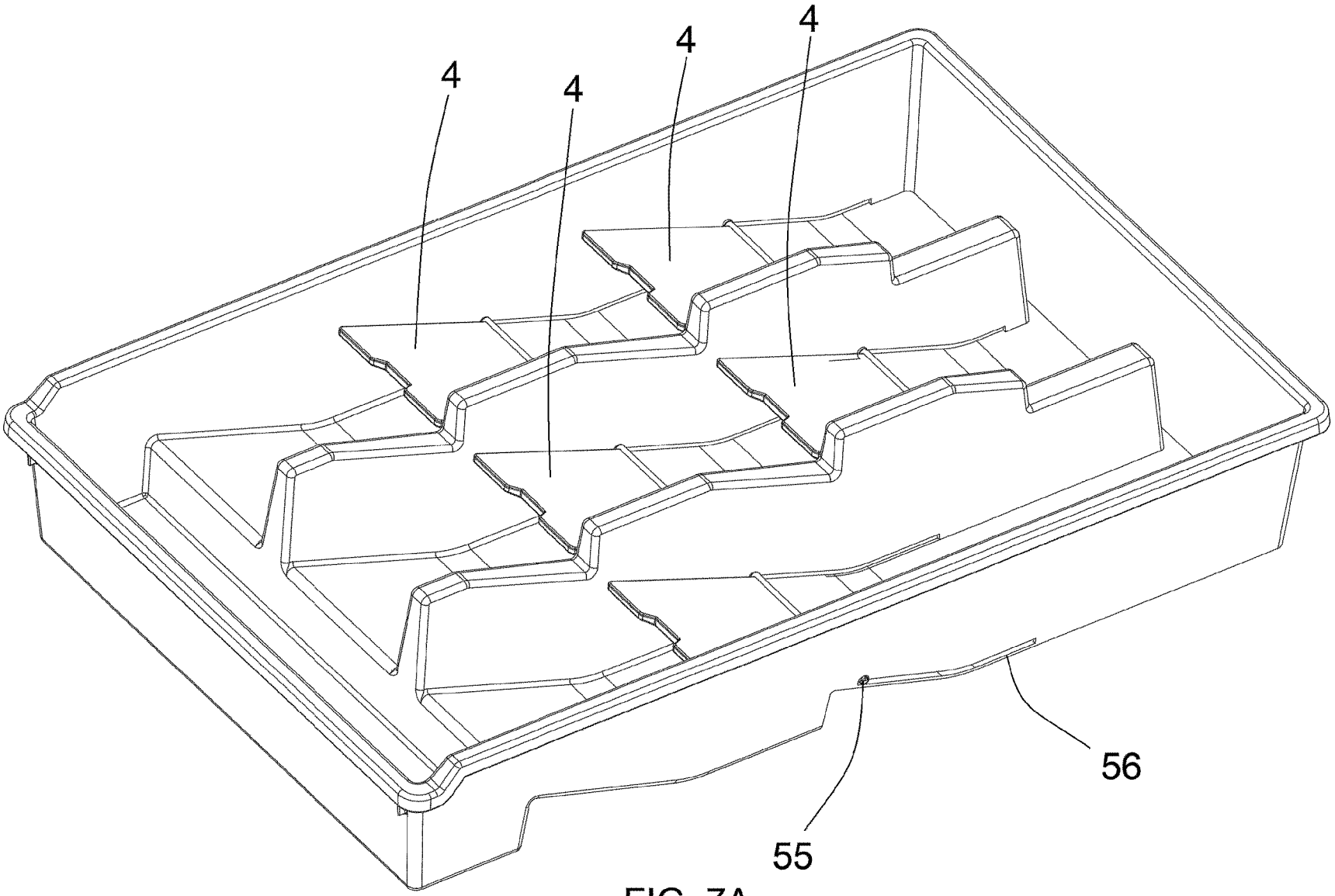

For illustrative purposes, with reference to FIGS. 7 and 7A, according to a second embodiment of the invention, said connection means may comprise:

- one or more sliders (55) connected to the inclined mobile partition (4), and
- a guide (56) for each slider wherein the slider (55) slides, in such a way to move the mobile partition (4) between said first position, which is shown in FIG. 7, and said second position, which is shown in FIG. 7A.

The aforementioned guide (56) may be alternatively obtained on the inclined bottom surface (10) or on one or both longitudinal lateral edges (2) of said longitudinal cavity (1) (as shown in FIGS. 7 and 7A).

Figure 8:
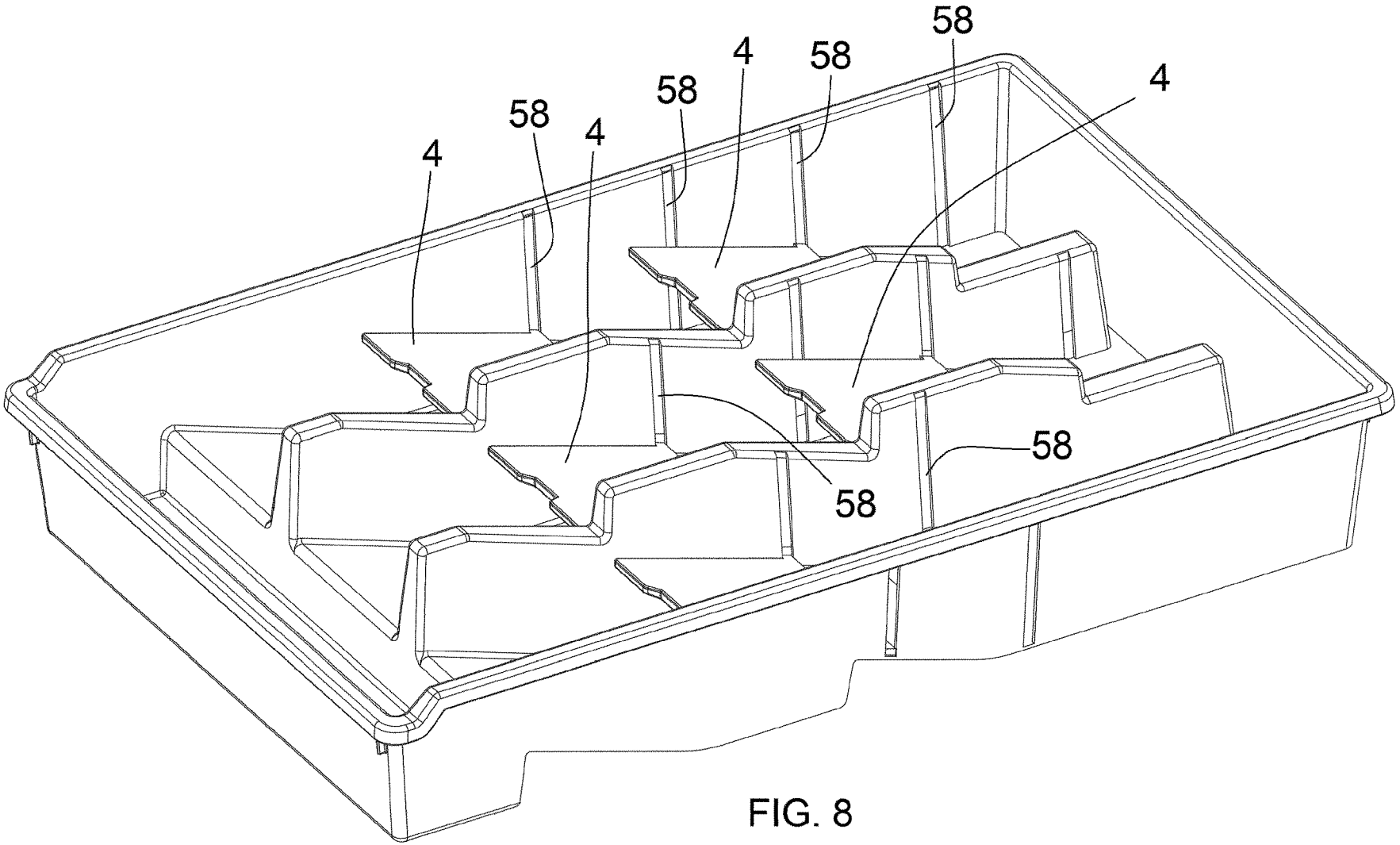
FIG. 8 is an axonometric view of the cutlery tray according to an additional alternative embodiment of the invention that differs in the type of connection means of the mobile partitions.
Figure 8A:
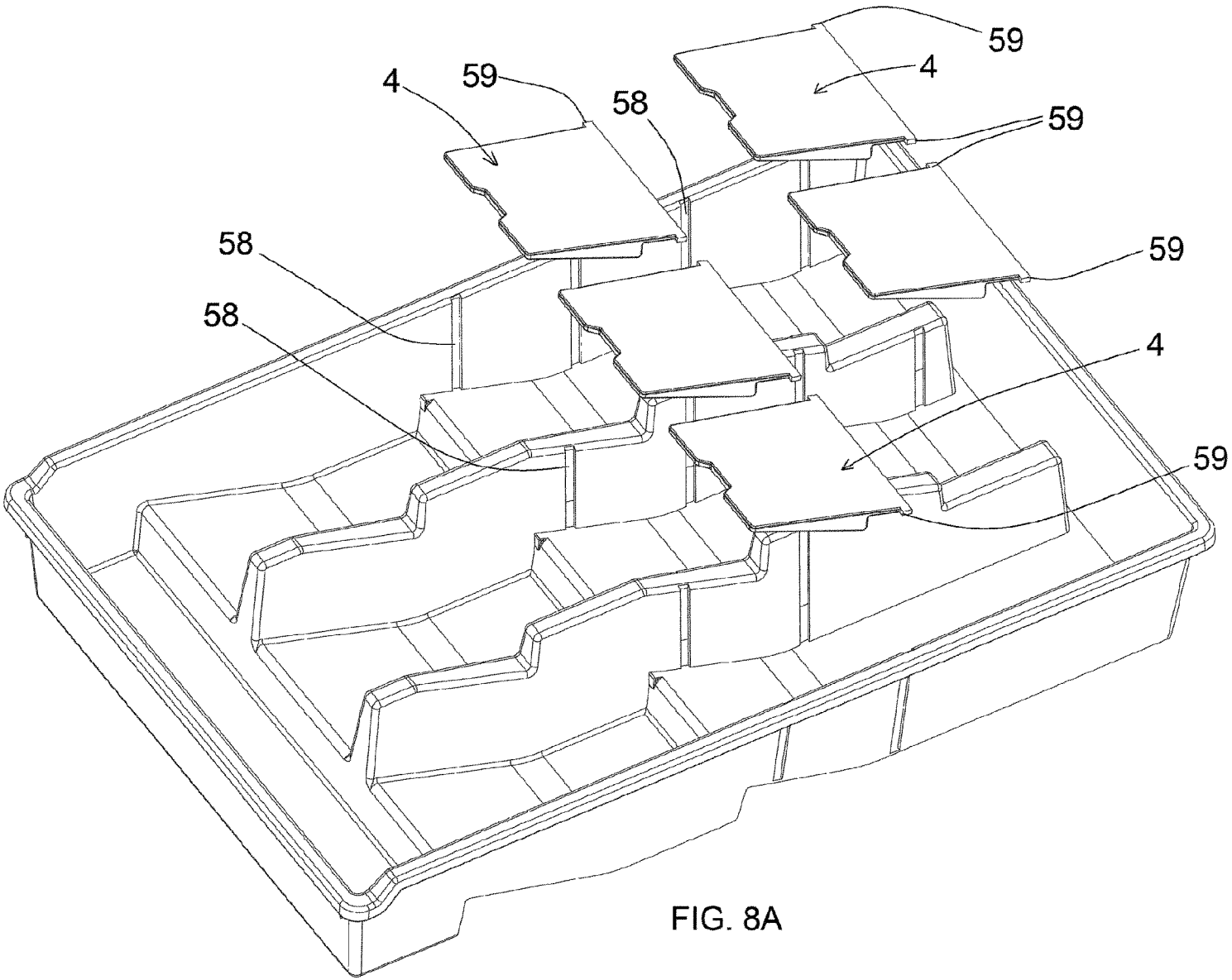
FIG. 8A is an axonometric view of the cutlery tray of FIG. 8, wherein the mobile partitions are extracted from the cutlery tray.

Additionally, with reference to FIGS. 8 and 8A, said connection means may also comprise:

- at least first and second grooves (58) obtained on one or both longitudinal lateral edges (2) of said longitudinal cavity (1); and
- projections (59) obtained on the mobile partition (4) and suitably shaped so as to be inserted into said grooves (58) from above.

With reference to FIG. 8A, the projections (59) can be alternatively inserted in the first or in the second grooves (58) in such a way as to position the mobile partition (4) in said first position or in said second position.

A series of intermediate grooves can be obtained between said first and second grooves, in such a way that said mobile partition (4) may be positioned in a series of intermediate positions between said first and said second position or in a series of different positions depending on how much each mobile partition (4) is to project with respect to the inclined bottom surface (10) of the longitudinal cavity (1).

Figure 6:
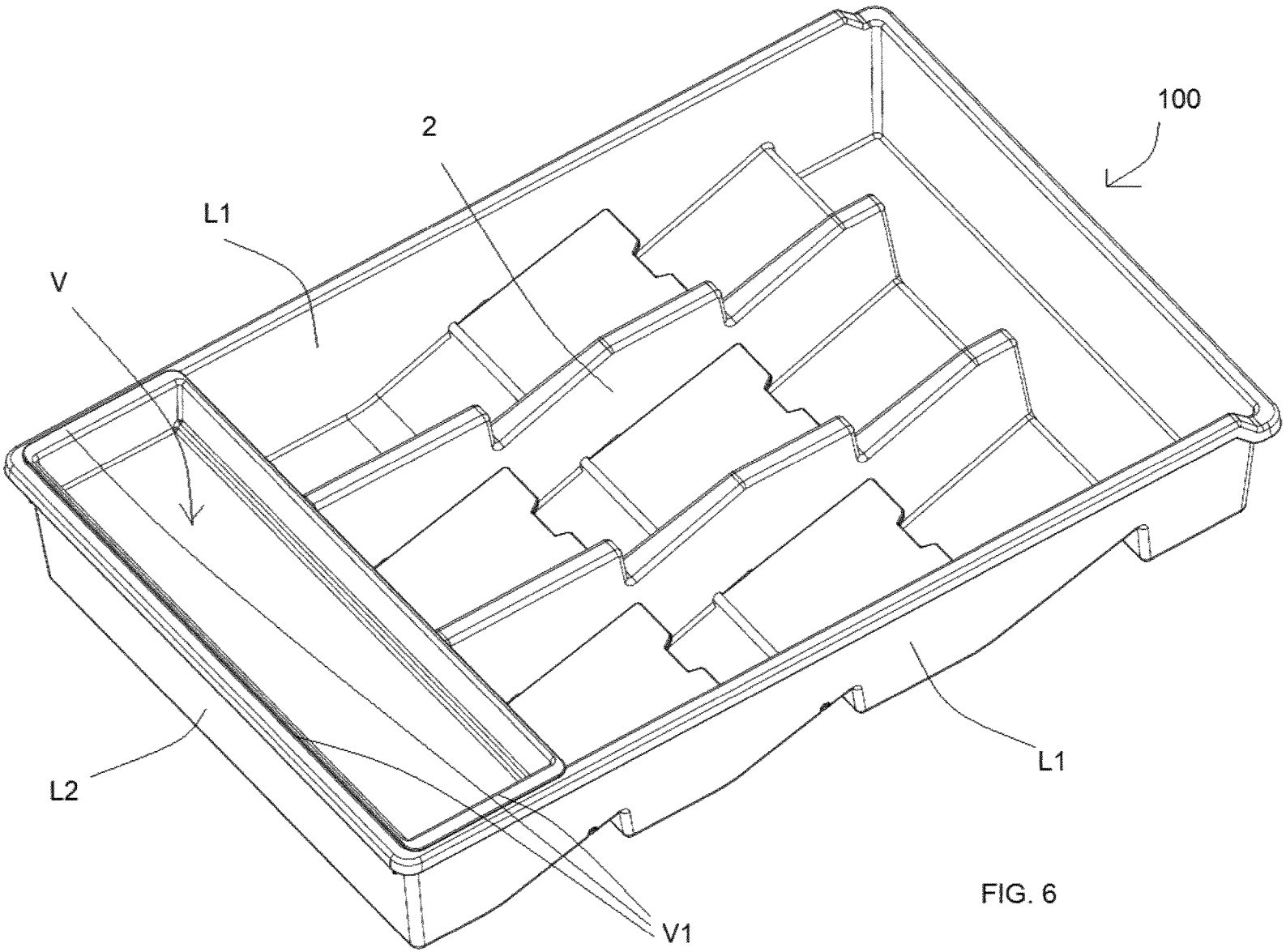
FIG. 6 is an axonometric view of the cutlery tray of FIG. 1 provided with a cutlery compartment.

With reference to FIG. 6, in a preferred embodiment of the invention, the cutlery tray (100) further comprises a removable, quadrangular compartment (V) with ending edges (V1) suitably configured to engage or rest on three adjacent border edges (L1, L2).

In particular, as shown in FIG. 6, the ending edges (V1) rest on one of said transverse border edges (L2) and on the two longitudinal border edges (L1).

Additional cutlery, such as spoons or the like, can be arranged inside the compartment (V).

In view of the preceding description, the inventive solution that has allowed the applicant to solve the drawbacks of the prior art is now manifest.

In particular, because of the provision of one or more mobile partitions (4), if a kitchen utensil or a piece of cutlery is longer than the inclined bottom surface (10), the supporting surface of the longitudinal cavity (1) can be extended in such a way that the piece of cutlery or the kitchen utensil is correctly disposed and firmly housed in the longitudinal cavity (1).

Therefore, the inventive solution adopted by the applicant provides a cutlery tray (100) with versatile longitudinal cavities (1), the supporting surface of which can be adapted and extended as desired according to the length of the kitchen utensils and of the cutlery that need to be stored.

Moreover, the presence of the aforementioned inclined mobile partitions (4) allows for making the best use of the space along the longitudinal direction of the cutlery tray, that is along the space between the transverse border edges (L2) of the cutlery tray (100).

Compared to a cutlery tray of the prior art, the cutlery tray (100) can be provided with a greater number of longitudinal cavities (1) along the same row because, when the inclined mobile partitions (4) are in their second position, the supporting surfaces of each longitudinal cavity (1) are partially superimposed.

Moreover, it must be noted that, due to the fact that the inclined mobile partitions (4) can be moved between the first position and the second position, the present invention also allows to obtain a cutlery tray (100) with compact volume for storage and transportation purposes.

More precisely, during storage or transportation, all inclined mobile partitions (4) are disposed in the first position, in such a way that they are superimposed to the inclined bottom surface (10) and they do not protrude from the lateral edges.

Evidently, in view of the above, a plurality of cutlery trays (100) can be stacked one on top of the other in a stable manner.

Numerous variations and modifications may be made to the present embodiment of the invention, within the scope of a person skilled in the art, and in any case within the scope of the invention as expressed by the appended claims.

The invention claimed is:

1. Cutlery tray comprising at least one longitudinal cavity wherein cutlery is to be disposed, said longitudinal cavity comprising:

an inclined bottom surface comprising an upper transverse section and a lower transverse section;

two longitudinal lateral edges with said inclined bottom surface in intermediate position between them;

a transverse edge disposed at the lower transverse section extending between the two longitudinal lateral edges;

an inclined mobile partition disposed in said longitudinal cavity, between the two longitudinal lateral edges;

connection means configured in such a way that said inclined mobile partition can be alternatively disposed in:

a first position, wherein said inclined mobile partition is superimposed to said inclined bottom surface;

a second position, wherein said inclined mobile partition projects with respect to said inclined bottom surface beyond the upper transverse section, in such a way to increase the length of the supporting surface for the cutlery.

2. The cutlery tray of claim 1, wherein said connection means comprise:

a pair of lateral pins in axially aligned position, each one of them being connected to the inclined mobile partition and being directed towards one of the two longitudinal lateral edges; and a pair of holes in axially aligned position, each one of them being obtained in one of said two longitudinal lateral edges of said cavity and revolvingly housing one of said lateral pins.

3. The cutlery tray of claim 1, wherein said connection means comprise:

at least one slider that is integral with said inclined mobile partition; and a guide for said at least one slider, wherein said slider slides; said guide being provided on said inclined bottom surface or on one of the longitudinal lateral edges of said longitudinal cavity.

4. The cutlery tray of claim 1, wherein said connection means comprise:

at least first and second grooves obtained on the two longitudinal lateral edges of said longitudinal cavity; and projections obtained on the mobile partition and suitably shaped in such a way to be inserted in said grooves.

5. The cutlery tray claim 1, comprising one or more consecutive longitudinal cavities that are aligned longitudinally and have the same width.

6. The cutlery tray of claim 5, wherein the longitudinal lateral edges of the two or more longitudinal cavities are monolithic.

7. The cutlery tray of claim 6, wherein the longitudinal lateral edges extend for the entire length of the cutlery tray.

8. The cutlery tray of claim 6, comprising a transverse cavity comprising a horizontal bottom surface with higher width than the longitudinal cavity.

9. The cutlery tray of claim 8, wherein said transverse cavity extends for the entire width of the cutlery tray.

10. The cutlery tray of claim 1, wherein said inclined bottom surface of the longitudinal cavity comprises two portions with different inclination, of which at least one is not horizontal.

11. The cutlery tray of claim 1, comprising quick-connection means for the longitudinal lateral edges.

* * * * *